US008480178B2

(12) United States Patent
Chiu et al.

(10) Patent No.: US 8,480,178 B2
(45) Date of Patent: Jul. 9, 2013

(54) ASSEMBLY CHAIR ASSEMBLED BY PLASTIC BOARD

(75) Inventors: Shih-Chan Chiu, Taipei (TW); Jeng-Neng Fan, Taipei (TW)

(73) Assignee: National Taiwan University Of Science And Technology, Taipei (TW)

( * ) Notice: Subject to any disclaimer, the term of this patent is extended or adjusted under 35 U.S.C. 154(b) by 0 days.

(21) Appl. No.: 13/365,362

(22) Filed: Feb. 3, 2012

(65) Prior Publication Data

US 2013/0127224 A1 May 23, 2013

(30) Foreign Application Priority Data

Nov. 18, 2011 (TW) ..... 100142229 A

(51) Int. Cl.
*A47C 7/00* (2006.01)

(52) U.S. Cl.
USPC ..... 297/440.12

(58) Field of Classification Search
USPC ..... 297/440.12, 440.1
See application file for complete search history.

(56) References Cited

U.S. PATENT DOCUMENTS

| | | | | |
|---|---|---|---|---|
| 2,940,511 | A * | 6/1960 | Gomes | 297/440.12 |
| 3,149,880 | A * | 9/1964 | Steuer | 297/440.12 |
| 3,604,751 | A * | 9/1971 | Caigan | 297/440.12 |
| 4,984,848 | A * | 1/1991 | Scalisi et al. | 297/440.12 |
| 2011/0278899 | A1 * | 11/2011 | Schouten et al. | 297/440.12 |

* cited by examiner

*Primary Examiner* — Milton Nelson, Jr.

(57) ABSTRACT

The present invention relates to an assembly chair assembled by plastic board, having a plurality of openings, a plurality of locking tabs, and a plurality of bending lines, and being capable of being bent and locked by hand and manpower for being formed into the assembly chair without any tools, or being capable of disassembling by hand and manpower for being formed into the plastic board without any tools, therefore, the assembly and the disassembly procedure can be easy; besides, the plastic board according to the present invention is flat before assembly, and being able to be stacked up for storage, therefore, the storage capacity of the plastic board is small, and the plastic board would not fall down when being stacked up for storage.

11 Claims, 7 Drawing Sheets

ASSEMBLY CHAIR ASSEMBLED BY PLASTIC BOARD

CROSS-REFERENCE TO RELATED APPLICATION

This application claims foreign priority from a Taiwan Patent Application, Ser. No. 100142229, filed on Nov. 18, 2011.

BACKGROUND OF THE INVENTION

1. Technical Field

The present invention relates to an assembly chair assembled by plastic board, in particular to a plastic board capable of being bent appropriately through human's hand and manpower to form into an assembly chair having a plurality of locking tabs and a plurality of openings.

2. Description of Related Art

Please refer to FIG. 1, it is shown a perspective view of a conventional chair. The conventional chair P1 includes a seat board P11, a main supporting frame P12, two side frames P13, a lower frame P14, four legs P15, and three block boards P16. The seat board P11 is located and fixed inside the lower frame P14, the main supporting frame P12 is disposed on the lower frame P14, the two side frames P13 set between the block boards P16 are disposed on the lower frame P14 and covered by the main supporting frame P12, and the four legs are disposed under the lower frame P14.

However, the conventional chair P1 has drawbacks and shortcomings as follows:

1. inconvenient for storage: the constituting elements of the conventional chair with specific shape need large space to store, hence resulting a higher cost. The conventional chair with specific shape need to be handle with care when stacked up for storage to avoid falling down, so that, the conventional chair is inconvenient for storage.
2. the assembly procedure is complex: to accomplish the assembly, special tools are required during the assembly procedure of the conventional chair, for example, screwdriver or tape, thus, the assembly procedure is complex and lengthy.
3. the disassembly procedure is difficult: the constituting elements of the conventional chair are screwed or bonded together, thus some special tools are required when taking the conventional chair apart, for example, screwdriver or saw, and mostly, it is difficult when using a screwdriver to loosen screws or using a saw to cut the bond, moreover, the constituting elements are usually useless after the disassembly of the conventional chair.

Accordingly, in view of the aforementioned shortcomings and drawbacks, the inventor of the present application has made great efforts to make inventive research thereon and eventually provided an assembly chair assembled by plastic board.

BRIEF SUMMARY OF THE INVENTION

The first objective of the present invention is to provide an assembly chair assembled by plastic board. Since the plastic board is flat before the assembly, the storage capacity of the plastic board is small, moreover, the plastic board would not fall down when many plastic boards are stacked up for storage.

The second objective of the present invention is to provide an assembly chair assembled by plastic board, in which, through human's hand and manpower, the plastic board can be bent and locked for combining the assembly chair without using any assembly tools, so that, the assembly procedure of the assembly chair can be easily completed.

The third objective of the present invention is to provide an assembly chair assembled by plastic board, in which, through human's hand and manpower, the assembly chair can be unlocked for being disassembled to a plastic board without any disassembly tools, so that, the disassembly procedure of the assembly chair can be easily finished.

Accordingly, to achieve the above objectives of the present invention, the inventor proposes an improved assembly chair assembled by plastic board, comprising: a seat portion, having a cutting line extended outwardly from the center of the seat portion with a first end, and a first folding line formed on the circumference of the seat portion; a first locking portion, being connected to one side of the seat portion, the first locking portion having a first locking tab and a first sub-opening formed on the surface of the first locking tab, moreover, a second folding line formed on the circumference of the first locking tab; a second locking portion, being opposite to the first locking portion and connected to one side of the seat portion, the second locking portion having a second locking tab and a first sub-locking tab formed on the surface of the second locking tab, moreover, a third folding line formed at the circumference of the second locking tab; a supporting portion, being opposite to the first end and connected to one side of the seat portion, the supporting portion comprising: a first supporting surface, being opposite to the seat portion; and two second supporting surfaces, being formed on the two sides of the first supporting surface, respectively; a first rear portion, being connected to one side of the supporting portion, and having a first opening and at least a third locking tab, wherein the third locking tab is opposite to the supporting portion; and a second rear portion, being opposite to the first rear portion and connected to one side of the supporting portion, and having a second opening and at least a third opening.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To more clearly describe an improved assembly chair assembled by plastic board according to the present invention, embodiments of the present invention will be described in detail with reference to the attached drawings hereinafter.

Figure 1:
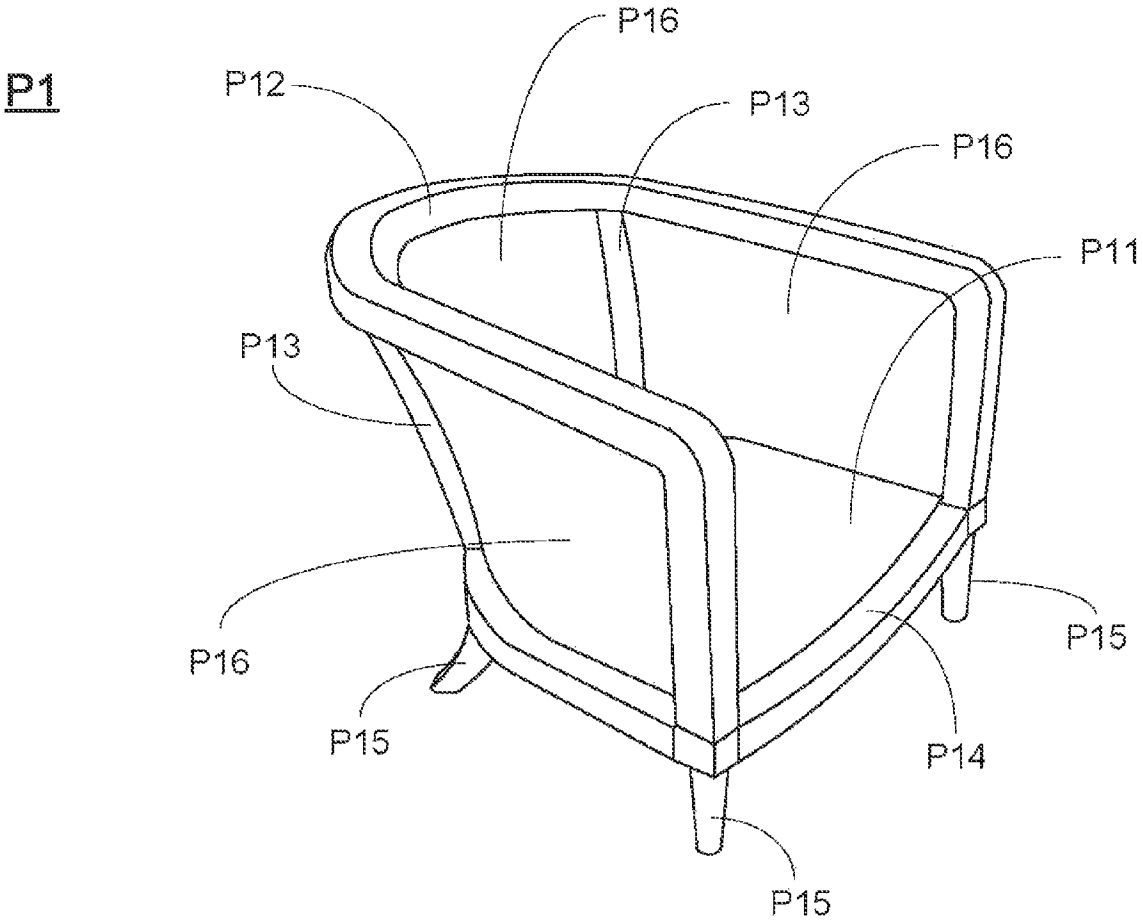
FIG.1 (Prior Art)
FIG. 1 is a perspective view of a conventional chair.
Figure 2:
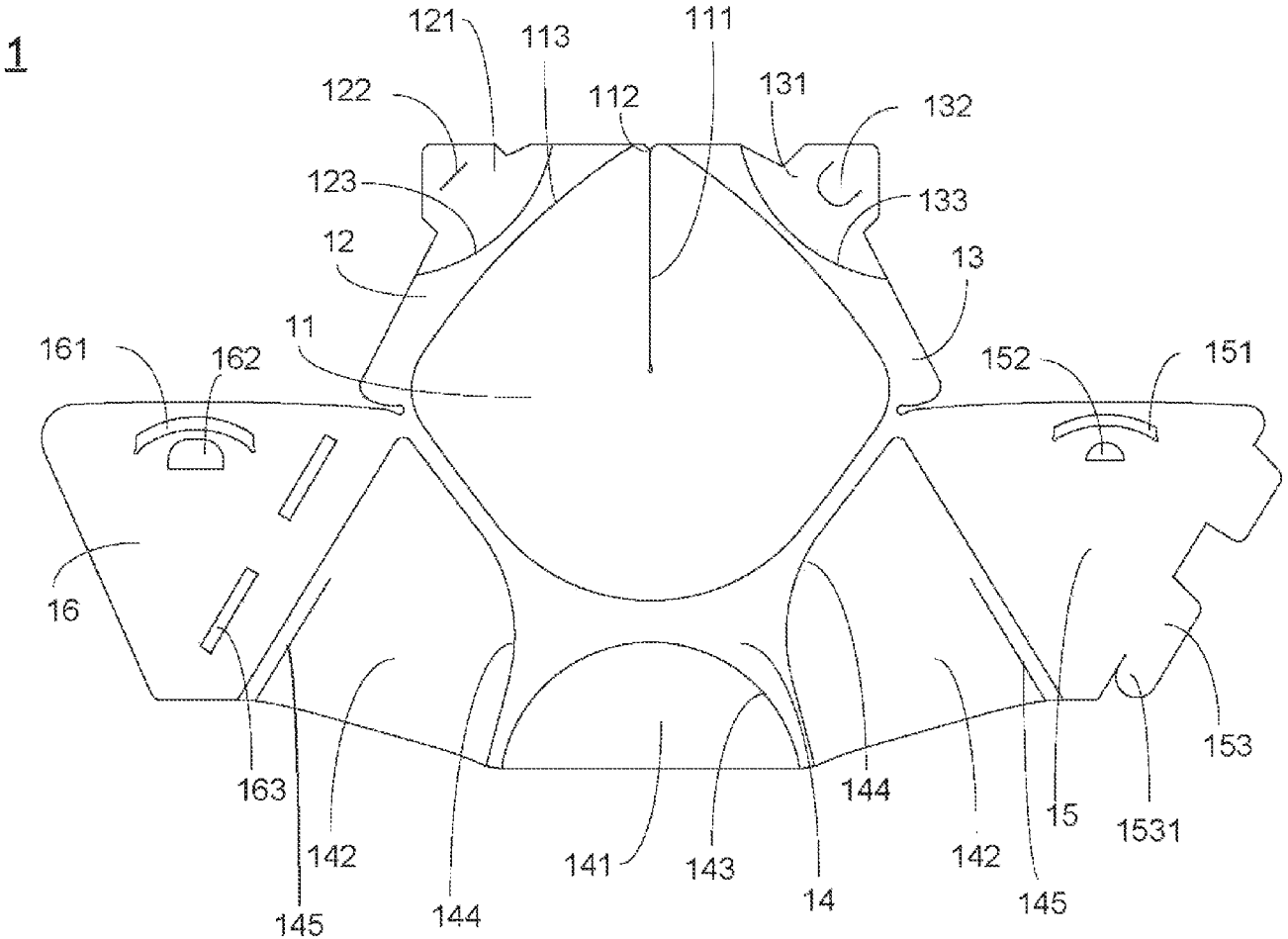
FIG. 2 is an exploded view of the assembly chair assembled by plastic board according to the present invention.

Referring first to FIG. 2, there is shown an exploded view of the assembly chair assembled by plastic board according to the present invention. As shown in FIG. 2, An assembly chair assembled by plastic board is formed by an integrated plastic board 1, the material of the plastic board 1 is polypropylene (PP); the plastic board 1 mainly includes a seat portion 11, having a cutting line 111 extended outwardly from the center of the seat portion 11 to a first end 112, and a first folding line 113 formed at the circumference of the seat portion 11; a first locking portion 12, being connected to one side of the seat portion 11, the first locking portion 12 having a first locking tab 121 and a first sub-opening 122 formed on the surface of the first locking tab 121, moreover, a second folding line 123 formed on the circumference of the first locking tab 121; a second locking portion 13, being opposite to the first locking portion 12 and connected to one side of the seat portion 11, the second locking portion 13 having a second locking tab 131 and a first sub-locking tab 132 formed on the surface of the second locking tab 131, moreover, a third folding line 133 formed on the circumference of the second locking tab 131; a supporting portion 14, being opposite to the first end 112 and connected to one side of the seat portion 11, supporting portion 14 comprising a first supporting surface 141 and two second supporting surfaces 142, the first supporting surface 141 being opposite the seat portion 11, and the second supporting surfaces 142 being formed on the two sides of the first supporting surface 141, respectively; a first rear portion 15, being connected to one side of the supporting portion 14, and having a first opening 151, a second opening 152, and at least a third locking tab 153, wherein the second sub-opening 152 is formed beneath the first opening 151, the third locking tab 153 is opposite to the supporting portion 14; and a second rear portion 16, being opposite to the first rear portion 15 and connected to one side of the supporting portion 14, and having a second opening 161, a third sub-opening 162, and at least a third opening 163, wherein the third sub-opening 162 is formed beneath second opening 161.

Figure 3B:
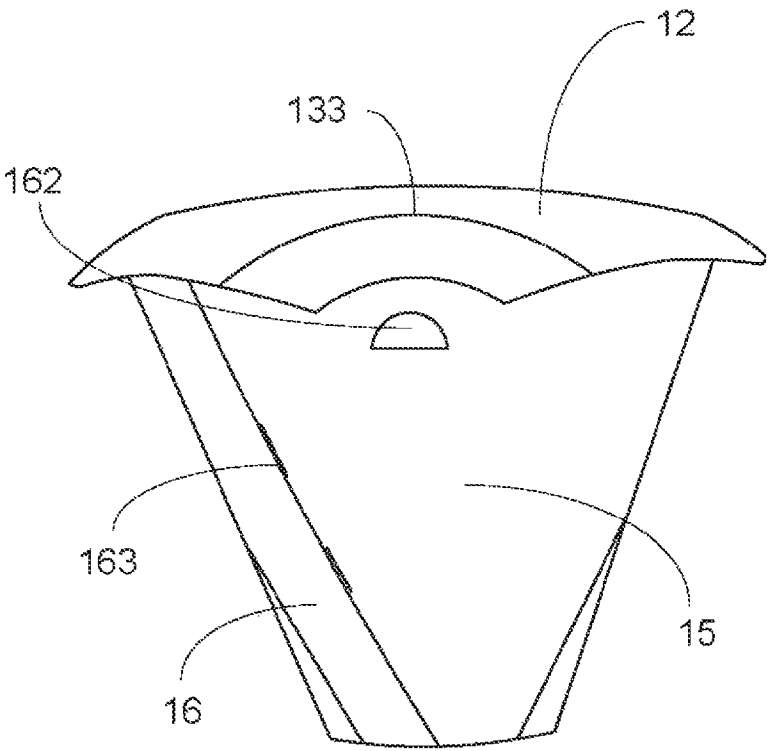
FIG. 3B is a front view of the assembly chair assembled by plastic board according to the present invention.
Figure 3A:
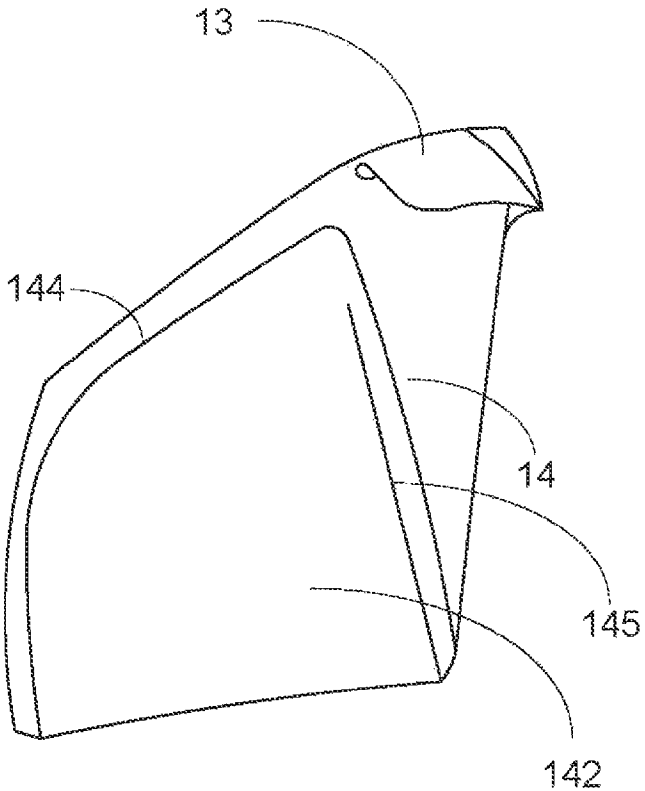
FIG. 3A is a side view of the assembly chair assembled by plastic board according to the present invention.
Figure 3C:
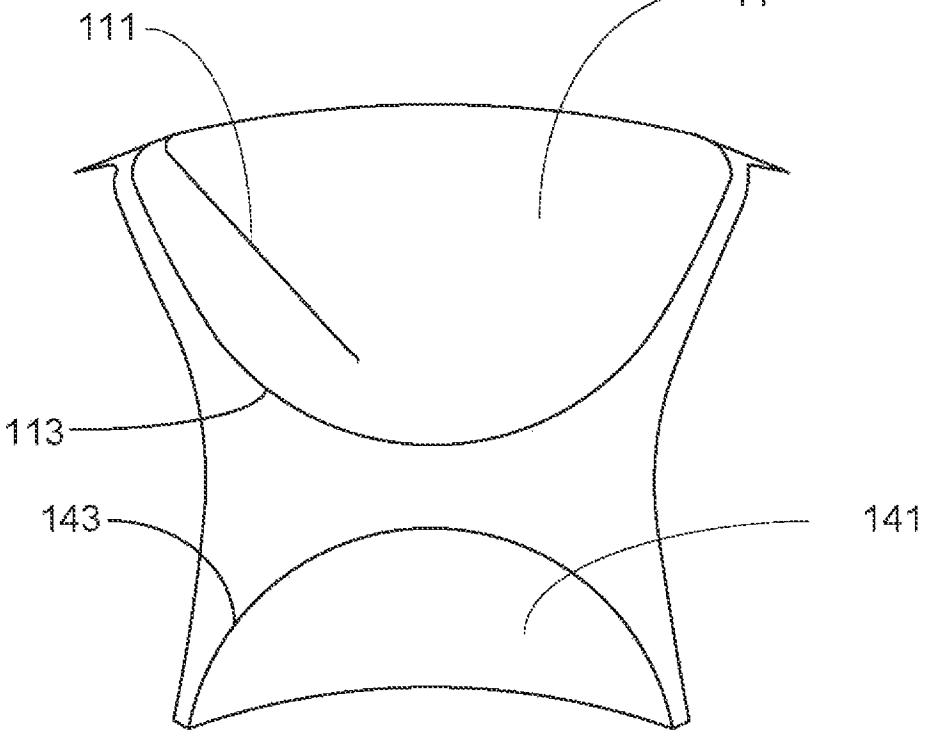
FIG. 3C is a rear view of the assembly chair assembled by plastic board according to the present invention.

Referring now to FIG. 3A-FIG. 3C, there are shown a side view of the assembly chair assembled by plastic board according to the present invention, a front view of the assembly chair assembled by plastic board according to the present invention, and a rear view of the assembly chair assembled by plastic board according to the present invention, respectively. When assembling the plastic board 1, the first locking tab 121 is overlapped the second locking tab 131, thus the first sub-locking tab 132 can be inserted into the first sub-opening 122, at the mean time, the seat portion 11 can be overlapped by the cutting line 111 and formed into a concave along the first folding line 113; after this, the supporting portion 14 is wrapped around the seat portion 11, and the third locking tab 153 can be inserted into the third opening 163, so that, the first opening 151 and the second sub-opening 152 are overlapped the second opening 161 and the third sub-opening 162 respectively, at the mean time, the first supporting surface 141 is at the front side of the seat portion 11, the second supporting surfaces 142 are at the two sides of the seat portion 11, and the first locking portion 12 is at the rear side of the seat portion 11 with the second locking portion 13; furthermore, the first locking tab 121 and second locking tab 131 are inserted downwards into the first opening 151 and the second opening 161 respectively, then the first sub-locking tab 132 is inserted upward into the second sub-opening 152 and the third sub-opening 162, in addition, the first locking tab 121 and the second locking tab 131 can be bent appropriately along the second folding line 123 and the third folding line 133, respectively.

A forth folding line 143 is formed on the circumference of the first supporting surface 141, and a fifth folding line 144 is formed at each circumference of the second supporting surface 142, when the supporting portion 14 is wrapped around the seat portion 11, the first supporting surface 141 and the second supporting surfaces 142 are formed concave along the fourth folding line 143 and the fifth folding line 144 respectively; besides, the best thickness of the plastic board 1 is 3 mm, thus the plastic board 1 can be bent easily; moreover, the first folding line 113, the second folding line 123, the third folding line 133, the fourth folding line 143, and the fifth folding line 144 are formed on the surface of the plastic board 1 with the same width and depth of 6 mm and 2 mm, respectively.

The third locking tab 153 further includes a fixing portion 1531, thus the third locking tab 153 can be locked with the third opening 163 after being inserted into the third opening 163; moreover, each of the second supporting surfaces 142 is further formed with at least a sixth folding line 145, thus the second supporting surfaces 142 can be bent appropriately along the sixth folding line 145 when the second supporting surfaces 142 are formed concave along the fifth folding line 144; As shown in FIG. 3, the embodiment of the present invention is the state after assembly, wherein the seat portion 11 is held up steadily by the first supporting surface 141 and the second supporting surfaces 142 when suffered a loading, thus the present invention can absolutely keep the shape from transformation.

Figure 4:
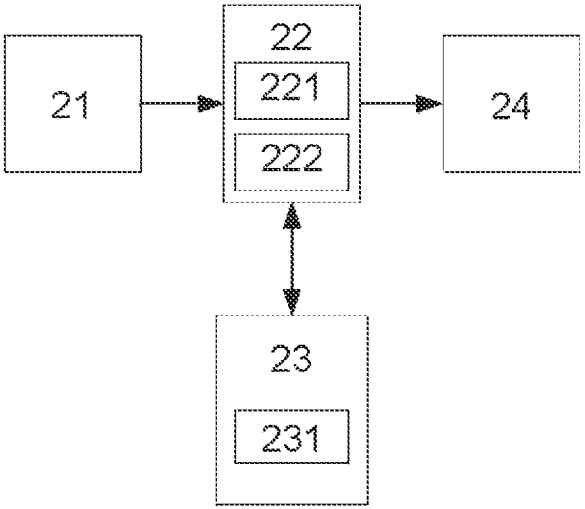
FIG. 4 is a block diagram showing the automatic manufacture according to the present invention.
Figure 5:
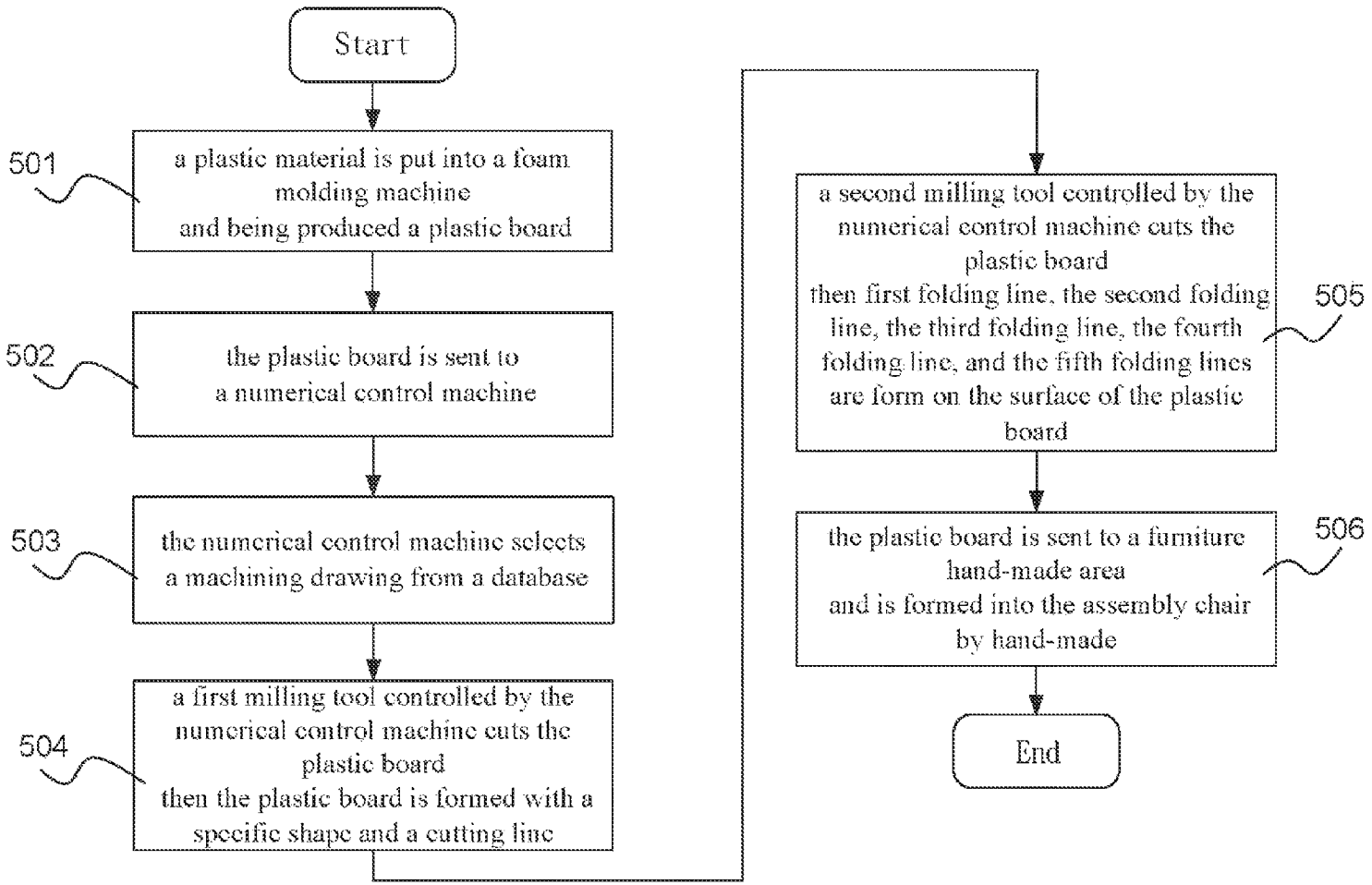
FIG. 5 is a flow chart showing the automatic manufacture according to the present invention.

The present invention can be manufactured by a way of automatic manufacture, please refer to FIG. 4 and FIG. 5 are shown a block diagram showing the automatic manufacture according to the present invention, and a flow chart showing the automatic manufacture according to the present invention, respectively; the automatic manufacture according to present invention includes a foam molding machine 21, a numerical control machine 22, a database 23, and a furniture hand-made area 24, wherein the numerical control machine 22 further includes a first milling tool 221 and a second milling tool 222, and the database 23 connected with the numerical control machine 22 further includes a machining drawing 231.

Please continue to the above description, the flow of the automatic manufacture according to the present invention mainly includes the steps as follow: (501) a plastic material is put into a foam molding machine 21, and being produced a plastic board, (502) the plastic board is sent to a numerical control machine 22, (503) the numerical control machine 22 selects a machining drawing 231 from a database 23, (504) a first milling tool 221 controlled by the numerical control machine 22 cuts the plastic board, then the plastic board is formed with a specific shape and a cutting line, (505) a second milling tool 222 controlled by the numerical control machine 22 cuts the plastic board, then first folding line, the second folding line, the third folding line, the fourth folding line, and the fifth folding lines are form on the surface of the plastic board, and (506) the plastic board is sent to a furniture hand-made area 24, and is formed into the assembly chair by hand-made.

Figure 6:
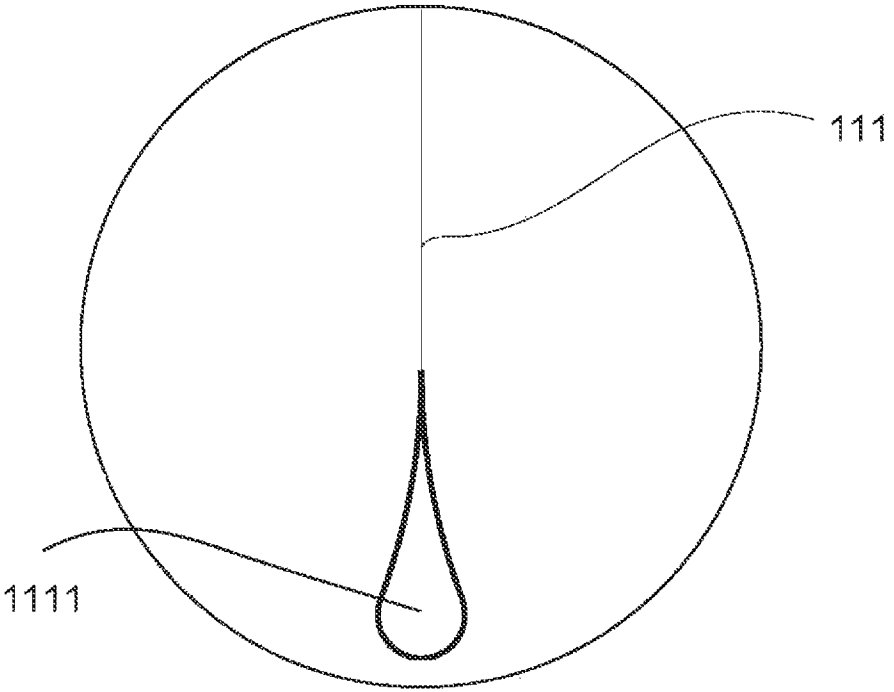
FIG. 6 is a pupil view of the cutting line according to the present invention.

Referring to FIG. 6, it is shown a pupil view of the cutting line according to the present invention; the numerical control machine 22 is a computer numerical control (CNC) machine, and the plastic board can be located and vacuumed on the machining stage of the numerical control machine 22, wherein the diameter of the first milling tool 221 is 4 mm, thus the width of the cutting line 111 is 4 mm, and one end of the cutting line 111 opposite to the first end further including an arc 1111; besides, the diameter of the second milling tool 222 is 6 mm; moreover, the plastic board can be formed into the assembly chair by hand-made in the furniture hand-made area 24 according to the present invention.

Thus, through above descriptions, it knows that how to get another practical embodiment for the assembly chair assembled by plastic board according to the present invention. However, the embodiments are not intended to limit the scope of the present invention; therefore, the above descriptions have been clearly and completely introduced the assembly chair assembled by plastic board of the present invention; in summary, the present invention has the following advantages:

1. the plastic board can be stored conveniently: since the plastic board according to the present invention is flat before assembly, and able to be stacked up for storage, therefore, the storage capacity of the plastic board according to the present invention is smaller than the conventional chair, moreover, the plastic board would not fall down when many plastic boards are stacked up for storage.
2. the assembly procedure can be easily completed: the plastic board according to the present invention formed from a polypropylene (PP) material has a plurality of the openings, a plurality of the locking tabs, and a plurality of the folding lines, and through man's hand and manpower the plastic board being able to be bent and locked for being formed into the assembly chair without any tools, so that, the assembly procedure of the assembly chair can be easily completed.
3. the disassembly procedure can be easily completed: through human's hand and manpower, the assembly chair according to the present invention is capable of disassembling for being formed into the plastic board without any tools, so that, the disassembly procedure can be easily completed, besides, the plastic board after disassembly also can be stored conveniently.
4. all the folding lines are on the same surface: all the folding lines according to the present invention, including the first folding line, the second folding line, the third folding line, the forth folding line and the fifth folding line, are formed on the same surface, thus, manufacturing process according to the present invention can be more simple than the chair provided by Fluxfurniture. Moreover, the chair provided by Fluxfurniture has no element like the cutting line, the first locking portion and the second locking portion according to the present invention, so that, the seat portion according to the present invention can be more solid than the chair provided by Fluxfurniture. Based on the above results, Applicant believes that the assembly chair assembled by plastic board according to the present application gets more inventive than the chair taught by Fluxfurniture.

The above description is made on embodiments of the present invention. However, the embodiments are not intended to limit the scope of the present invention, and all equivalent implementations or alterations within the spirit of the present invention still fall within the scope of the present invention.

We claim:

1. An assembly chair assembled by plastic board, comprising:

a seat portion, having a cutting line extended outwardly from the center of the seat portion with a first end, and a first folding line formed around the seat portion;

a first locking portion, being connected to one side of the seat portion, the first locking portion having a first locking tab and a first sub-opening formed on the surface of the first locking tab, moreover, a second folding line formed around the first locking tab;

a second locking portion, being opposite to the first locking portion and connected to one side of the seat portion, the second locking portion having a second locking tab and a first sub-locking tab formed on the surface of the second locking tab, moreover, a third folding line formed around the second locking tab;

a supporting portion, being opposite to the first end and connected to one side of the seat portion, the supporting portion comprising:

a first supporting surface, being opposite to the seat portion; and two second supporting surfaces, being formed on opposite sides of the first supporting surface, respectively;

a first rear portion, being connected to one side of the supporting portion, and having a first opening and at least a third locking tab, wherein the third locking tab is opposite to the supporting portion; and a second rear portion, being opposite to the first rear portion and connected to one side of the supporting portion, and having a second opening and at least a third opening.

2. The assembly chair assembled by plastic board of claim 1, wherein the third locking tab further includes a fixing portion, thus the third locking tab can be locked with the third opening after being inserted into the third opening.

3. The assembly chair assembled by plastic board of claim 1, wherein the width of the cutting line is 4 mm, and one end of the cutting line opposite to the first end further including an arc.

4. The assembly chair assembled by plastic board of claim 1, wherein the first rear portion further includes a second sub-opening formed beneath the first opening, and the second rear portion further includes a third sub-opening formed beneath the second opening.

5. The assembly chair assembled by plastic board of claim 4, wherein the first locking tab and the second locking tab are inserted downward into the first opening and the second opening, and the first sub-locking tab is inserted upward into the second sub-opening and the third sub-opening.

6. The assembly chair assembled by plastic board of claim 1, the said assembly chair is assembled by an integrated plastic board.

7. The assembly chair assembled by plastic board of claim 6, wherein the material of the plastic board is polypropylene.

8. The assembly chair assembled by plastic board of claim 6, wherein the thickness of the plastic board is in the range of 2.5 mm to 5 mm.

9. The assembly chair assembled by plastic board of claim 6, wherein a fourth folding line is formed around the first supporting surface and a fifth folding line is formed around the second supporting surfaces, when the supporting portion is wrapped around the seat portion, and the first supporting surface and the second supporting surfaces are formed concave along the fourth folding line and the fifth folding line respectively.

10. The assembly chair assembled by plastic board of claim 9, wherein the first folding line, the second folding line, the third folding line, the fourth folding line, and the fifth folding lines are formed on the surface of the plastic board with the same width and depth of 6 mm and 2 mm, respectively.

11. The assembly chair assembled by plastic board of claim 9, wherein each of the second supporting surfaces is further formed with at least a sixth folding line, thus the second supporting surfaces can be bent appropriately along a sixth groove when the second supporting surfaces are formed concave along the fifth folding line.

* * * * *